US005669165A

United States Patent [19]

Santorsola

[11] Patent Number: 5,669,165

[45] Date of Patent: Sep. 23, 1997

[54] PICTURE CARD

[76] Inventor: Alan J. Santorsola, 6002 Beacon Ave. South, Seattle, Wash. 98108

[21] Appl. No.: 649,201

[22] Filed: May 17, 1996

[51] Int. Cl.[6] ..... G09F 1/00

[52] U.S. Cl. ..... 40/124.191; 40/495; 116/316; 229/92.8

[58] Field of Search ..... 40/115, 433, 435, 40/495, 124.01, 124.191; 116/309, 316, 318; 229/92.8; 434/402, 404

[56] References Cited

U.S. PATENT DOCUMENTS

| | | | |
|---|---|---|---|
| 884,394 | 4/1908 | Keegan | 40/495 |
| 903,514 | 11/1908 | Snyder . | |
| 966,107 | 8/1910 | Lowe | 40/495 |
| 1,168,592 | 1/1916 | Bedinger | 229/92.8 |
| 1,396,693 | 11/1921 | Rugh . | |
| 2,728,167 | 12/1955 | Knott | 40/495 X |
| 2,755,577 | 7/1956 | Greensfelder | 40/495 X |
| 2,959,872 | 11/1960 | Rodgers | 40/495 X |
| 3,526,983 | 9/1970 | Klauber | 40/433 |
| 3,776,725 | 12/1973 | McCann et al. | 430/15 |
| 3,891,305 | 6/1975 | Fader | 350/144 |
| 4,640,030 | 2/1987 | Wood et al. . | |
| 4,681,253 | 7/1987 | Engelhardt | 229/92.8 |
| 4,995,185 | 2/1991 | Cheng | 40/582 |

FOREIGN PATENT DOCUMENTS

| | | | |
|---|---|---|---|
| 2230228 | 10/1990 | United Kingdom | 229/92.8 |

*Primary Examiner*—Brian K. Green

*Attorney, Agent, or Firm*—David P. Campbell; Glenn D. Bellamy; Kathleen T. Petrich

[57] ABSTRACT

A picture card (9) including a front card (11), a back card (10), a first transparency (14) and a second transparency (18). First and second transparencies are rotatably secured together by means of grommet (20) and second transparency (18) is mounted to back card (10). First transparency (14) preferably includes an image similar to that of second transparency (18), whereby first transparency (14) can be rotated to align its image with the image of second transparency (18).

5 Claims, 4 Drawing Sheets

PICTURE CARD

TECHNICAL FIELD

The present invention pertains to picture cards, and more particularly to a unique card, such as, for example, a postcard, greeting card, or baseball card having transparent overlays.

BACKGROUND OF THE INVENTION

U.S. Pat. No. 966,107 of C. E. Lowe, entitled "Postcard", discloses a postcard with a set of circular disks rotatably secured inside the postcard. A pie shaped opening is provided in the front of the postcard so that a section of each inner disk can be written on and read as the disk is rotated. If more than one disk is used, each outer disk is provided with an opening, to allow for reading and writing on inner disks.

U.S. Pat. No. 1,168,592, of S. B. Bedinger, entitled "Coin holding postcard", discloses a postcard for holding coins on a circular disk. The coin holding circular disk is secured to the postcard in a manner that is difficult to remove, thus allowing the postcard to be sent through the mail in a manner securing safe delivery.

U.S. Pat. No. 4,640,030, of Wood et al, entitled "Combination envelope and display devise", discloses a postcard having a perforated and removable outer panel, that when removed exposes an inner picture. The address and stamp are placed on the perforated removable panel.

U.S. Pat. No. 4,681,253 of Engelhardt, entitled "Efficiency photo-gram with stand-up display", discloses what is termed a photo mailer that is configured to hold a photograph and personnel communique in a concealed manner, which can be displayed in upright position for viewing.

The foregoing patents are illustrative of previous attempts to improve upon the basic postcard format that has been used for many years in this country. The present invention continues in this effort to provide a more interesting postcard format. However, the present invention can also be utilized in other card formats, such as in greeting cards and baseball cards.

DISCLOSURE OF THE INVENTION

Briefly described, the present invention comprises a picture card including a front panel having an opening therein, a first transparency having an image therein, and a second transparency having the same image therein as the first transparency. The first transparency is secured to the front panel, over the opening therein. The second transparency is rotatably secured between the first transparency and the front panel. The second transparency can be rotated to bring its image into alignment with the image of the first transparency.

Preferably, the second transparency is rotatably secured to the first transparency. Also, the first transparency is larger than the second transparency, so that the outer peripheral edges of the first transparency overlay the second transparency and can be mounted to the front panel.

With the present invention, various types of picture cards can have multiple layers of the same image arranged on the card wherein at least one of the images can be rotated to align its image with the other images and bring the picture into focus. The present invention can be used for post card, greeting cards, baseball cards, and various other types of cards that commonly include a picture.

According to an aspect of the invention, the picture card further includes a back panel having an opening therein adapted to align with the opening of the front panel. The first transparency is secured to the front panel by first being secured to the back panel, and the back panel is secured to the front panel. This is one of the preferred arrangements of the present invention. However, other arrangements work equally as well. For example, one image could be imprinted directly on the front panel, with the front panel not having an opening therein. A transparency is rotatably secured to the front panel over its image. Another arrangement is where the back panel has an image imprinted directly thereon, and the front panel has an opening to view the image on the back panel. A transparency is rotatably secured to the back panel.

According to another aspect of the invention, the images of the picture card each do not individually include a full spectrum of colors, but combined do include a full spectrum. In this manner, when the images are rotated out of focus, it is more difficult to determine what the picture is suppose to be.

According to another aspect of the invention, the first and second transparencies each include two images oriented at an angle to one another. The second transparency can be rotated to a first position wherein one of its images aligns with one of the images of the first transparency, and can be rotated to a second position wherein its other image aligns with the other image of the first transparency. This arrangement is useful to show, for example, a baseball player in a first position waiting for a pitch and then in a second position swinging at a ball.

These and other features, advantages, and objects of the present invention will become apparent from the following detailed description of the best mode, when read together with the drawings, and the claims, which are all incorporated herein as part of the disclosure of the invention.

BRIEF DESCRIPTION OF THE DRAWINGS

Like reference numerals are used to indicate like parts throughout the various figures of the drawing, wherein.

BEST MODE FOR CARRYING OUT THE INVENTION

Figure 1:
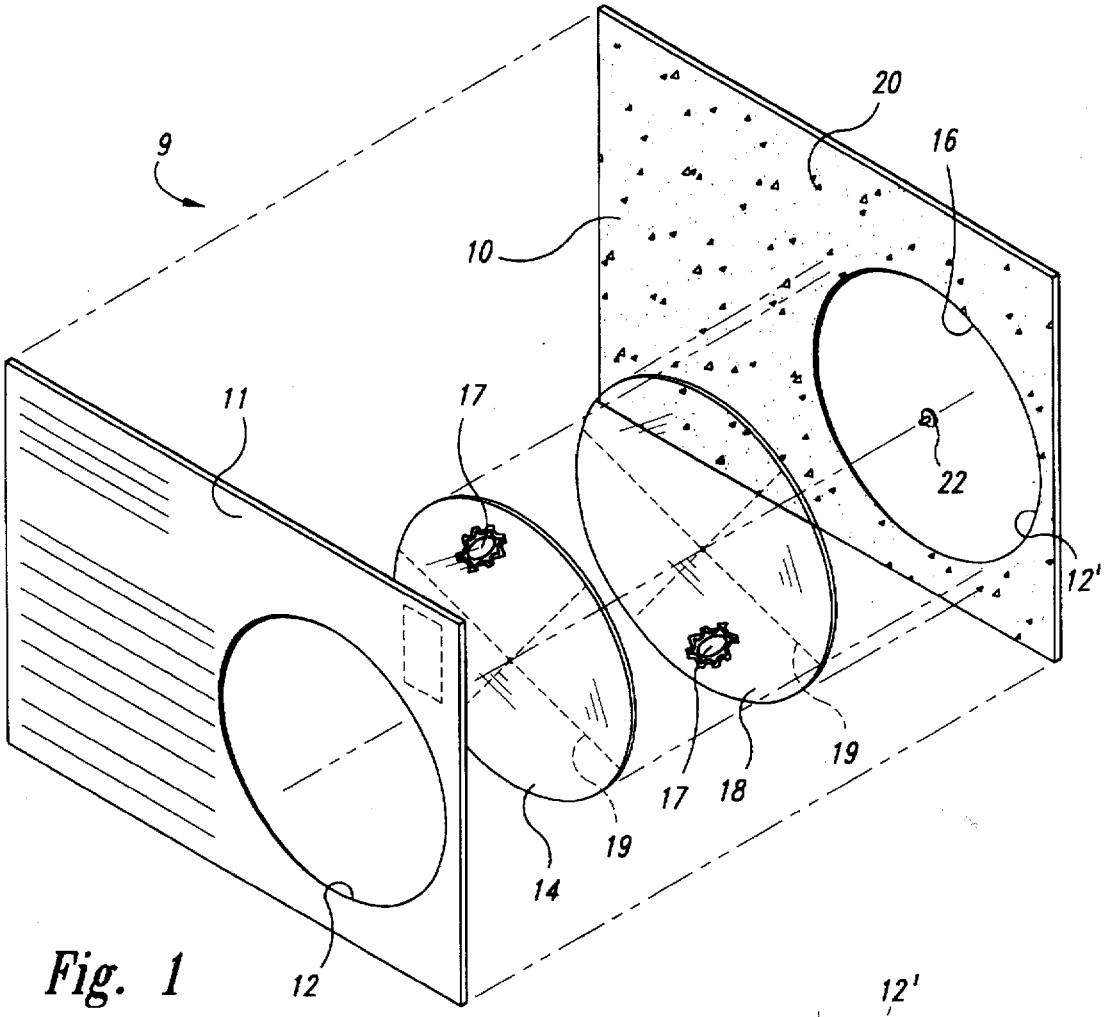
FIG. 1 is an exploded pictorial view of the picture card of the present invention, shown in a first embodiment thereof.
Figure 2:
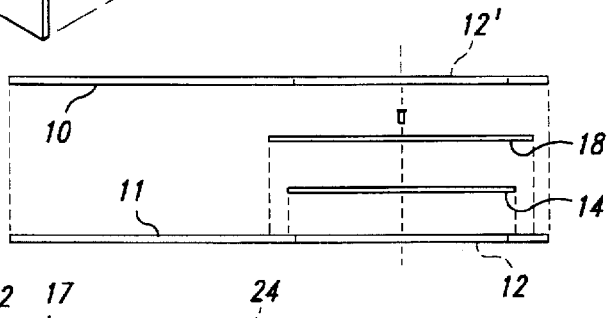
FIG. 2 is an exploded top plan view of the picture card of FIG. 1.
Figure 3:
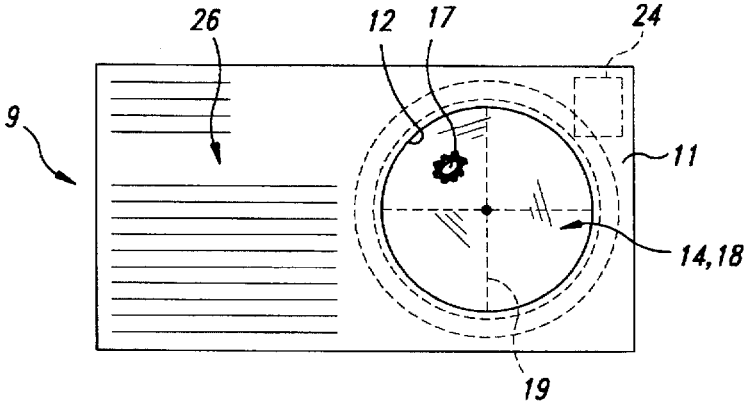
FIG. 3 is a front view of the picture card of FIG. 1.

Referring now to the drawings, FIGS. 1–3 illustrate a first embodiment of a picture card 9 according to the present invention. Picture card 9 includes first and second rectangular cards 10, 11, with card 11 comprising a front card and card 10 comprising a back card of picture card 9. Front card 11 and back card 10 are of equal, rectangular dimensions. Front card 11 includes a circular cut-out 12, and back card 10 includes a corresponding circular cut-out 12'. Cut-outs 12, 12' are of equal diameter. A pair of transparencies 14, 18 are sandwiched between front card 11 and back card 10. First transparency 14 is slightly smaller in diameter than second transparency 18. First transparency 14 is also slightly larger than the diameter of cut-outs 12, 12'. Each transparency 14, 18 includes an image 17 imprinted thereon. The layout and design of the images can vary. For example, first transparency 14 and second transparency 18 can have identical images printed thereon, both with a full range of colors. Alternatively, each transparency 14, 18 can be divided into sections or quadrants, as shown by dashed lines 19, with each quadrant defined by dashed lines 19 having a separate image imprinted thereon.

Regardless of the design and layout of the images on transparencies 14, 18, to assemble the picture card 9 of the present invention, an adhesive material 20 is applied to the inside surface of back card 10. Second transparency 18 is then centered over circular cut-out 12' so that the peripheral edges of second transparency 18 overlay the circular edge portion 16 that defines circular cut-out 12'. In this manner, second transparency 18 is secured to the inner side of back card 10. First transparency 19 is centered onto second transparency 18, and a grommet 22 is used to secure the two transparencies together. Front card 11 is then adhered to back card 10 via adhesive 20. With this arrangement, first transparency 14 is rotatably secured to second transparency 18, which is fixedly adhered to back card 10.

FIG. 3 is a front view of picture card 9 with transparencies 14, 18 aligned and framed by the circular cut-out 12 of front card 11. The outer surface of front card 11 includes a postage stamp marker 24, and an address and message space 26. A recipient of picture card 9 can rotate first transparency 14 to align the images of the two transparencies and bring the images into focus.

The design of FIGS. 1–3 can be slightly altered so that the transparencies 14, 18 each include, for example, four images, each to a quadrant thereof, with the images diagonally across from each other being switched or reversed so that first transparency 14 has to be rotated to a first position to align two of the diagonally opposed images, and then has to be rotated 180° to align the other two diagonally-opposed images.

As another alternative design to that shown in FIGS. 1–3, first and second transparencies 14, 18 could each include less than a full spectrum of colors, but have their images imprinted thereon so that the colors missing from one transparency are included in the other transparency. In this manner, the color scheme is further distorted when the two transparencies are rotated out of alignment.

Figure 4:
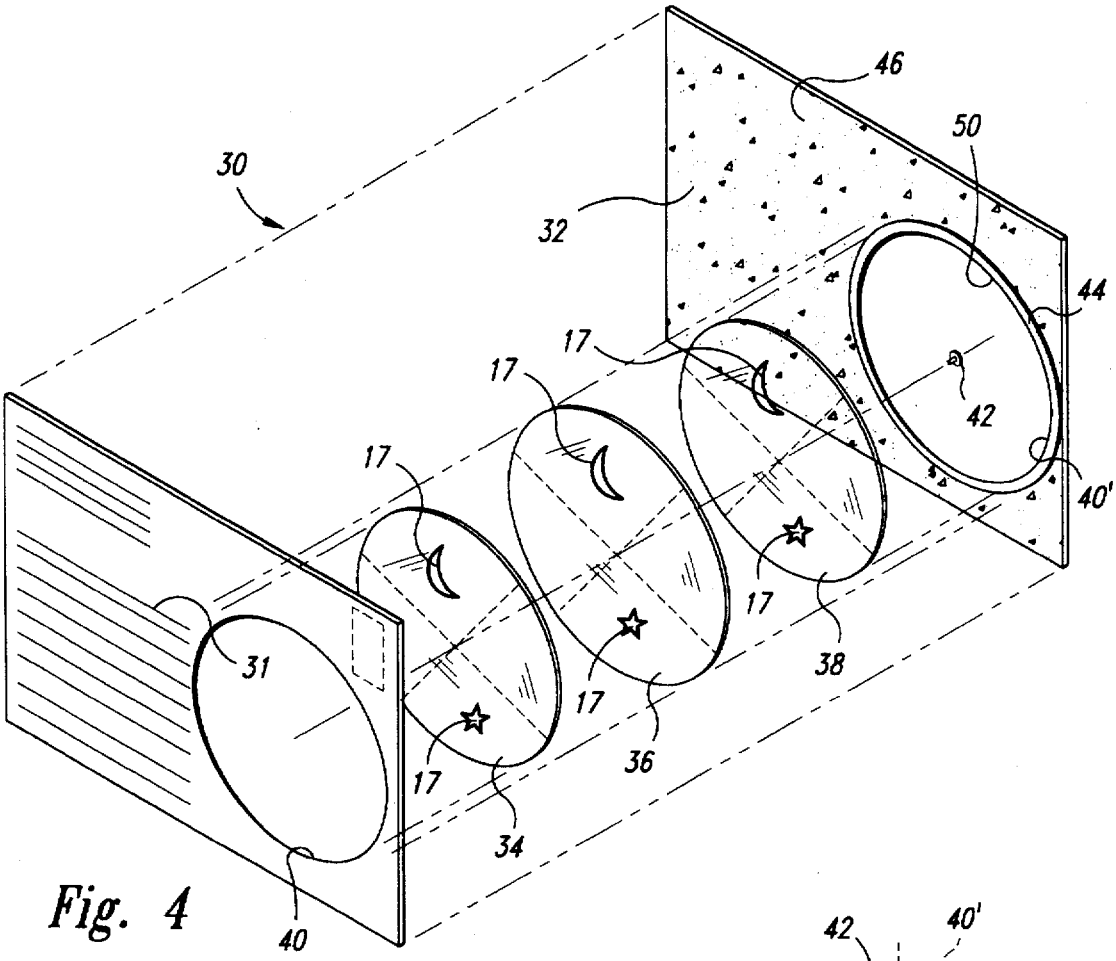
FIG. 4 is an exploded pictorial view of a second embodiment of the picture card of the present invention.
Figure 5:
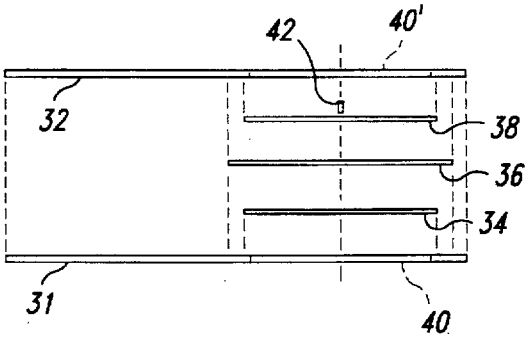
FIG. 5 is an exploded top plan view of the picture card of FIG. 4.
Figure 6:
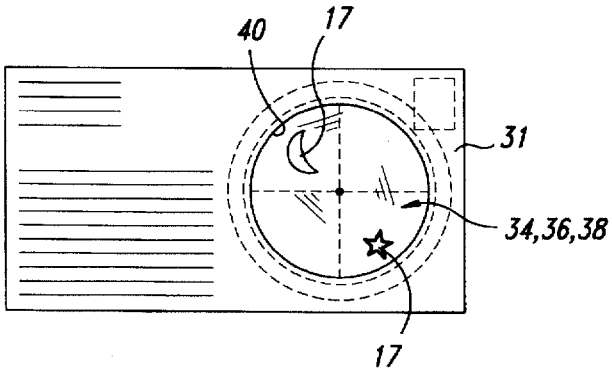
FIG. 6 is a front view of the picture card of FIG. 4.

FIGS. 4–6 show a second embodiment of a picture card 30 similar to that of picture card 9 of FIGS. 1–3. Picture card 30 includes a front card 31 and a back card 32. However, front and backs card 31, 32 sandwich first, second and third transparencies 34, 36, 38, respectively, therebetween. Second transparency 36 is larger in diameter than first and third transparencies 34, 38, in a manner similar to the size differential between the first and second transparencies of picture card 9. First and third transparencies 34, 38 preferably are of similar diameter, with each having a diameter slightly greater than circular cut-outs 40, 40' in front and back cards 31, 32. A grommet 42 is utilized to secure the three transparencies together in a manner that first and third transparencies 34, 38 can be rotated with respect to second transparency 36.

A quarter-inch paper ring 44 is positioned between third transparency 38 and back card 32. Paper ring 44 has an inner diameter approximately equal to the diameter of opening 40'. However, the thickness of ring 44 is not so great as to interfere with engagement between the peripheral edges of second transparency 36 and back card 32.

As with the first embodiment of FIGS. 1–3, an adhesive 46 is applied to the inner surface of back card 32, and ring 44 is secured about circular cut-out 40' to the circular edge 50 of back card 32. Ring 44 serves the purpose of covering up a thin margin of adhesive about circular cut-out 40' so that third transparency 38 does not stick to back card 32 and, thus, is free to rotate. Because second transparency 36 is larger in diameter than third transparency 38, the peripheral edges of second transparency 36 adhere to back plate 32 because they extend radially outwardly beyond third transparency 38. Front plate 31 is then adhered to back plate 32 in a manner that sandwiches the three transparencies between the front and back cards.

With this arrangement, both the first and third transparencies can be rotated with respect to the second transparency, which is fixed in position onto back plate 32. This design allows a greater number of design options. For example, each transparency can include one primary color, so that none of the colors appear true until the first and third transparencies are rotated into alignment with second transparency.

Figure 7:
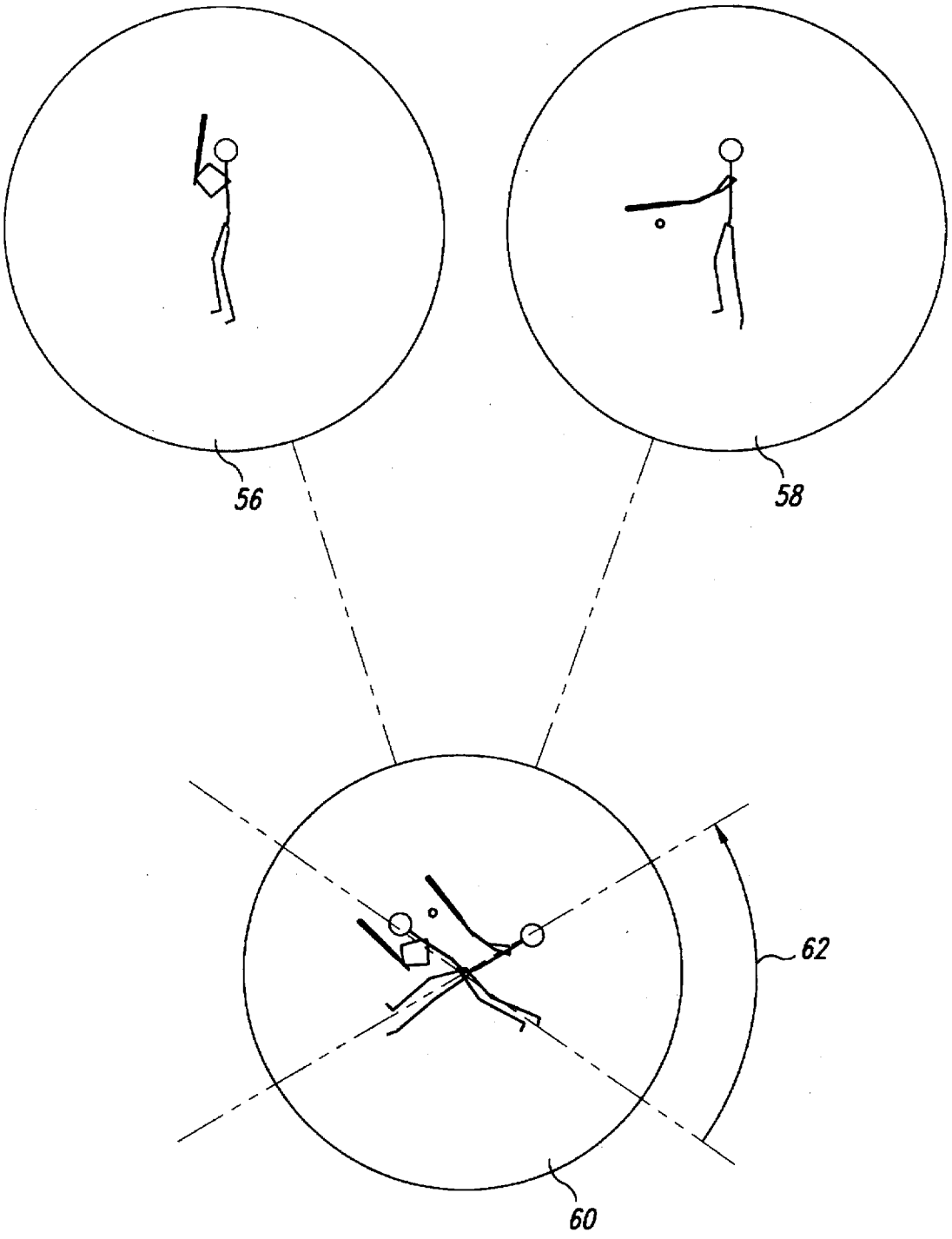
FIG. 7 is a schematic diagram illustrating the concept of a third embodiment of the picture card invention.

FIG. 7 illustrates a third embodiment of the present invention wherein the transparencies each contain two different images imprinted thereon in a manner that the two images overlap each other. A first image 56 and a second image 58, preferably having some conceptual relationship with each other, are imprinted on each transparency. In the embodiment of FIGS. 1–3, two transparencies would be provided, each with a dual image imprinted thereon, as shown by reference numeral 60. The two images of each transparency would be angled relative to each other, as shown by arrow 62. With the embodiment of FIGS. 4–6, all three transparencies would include the dual image of the transparency indicated by reference numeral 60. With the transparencies aligned along the axis of the first image, the first image is brought into focus while the second image is out of focus. With the transparencies aligned along the axis of the second image, that image is brought into focus, while the first image moves out of focus. With this embodiment, for example, a first image of a baseball player in an address position waiting for a pitch can be the first image, while the second image shows the baseball player swinging at a baseball and making contact. A recipient of the card would first rotate the first image into focus and then the second image into focus to simulate a baseball player swinging a baseball bat. Other dual image concepts can also be utilized, as will be understood by those skilled in the art.

Figure 8:
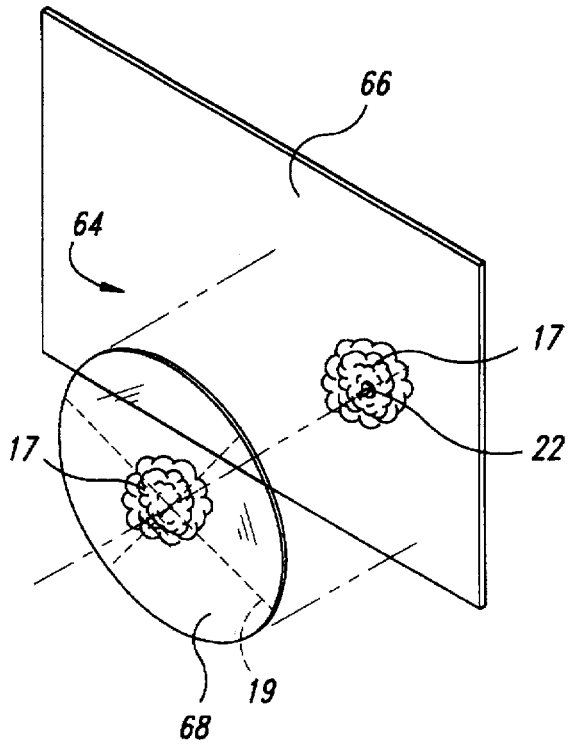
FIG. 8 is an exploded pictorial view of a fourth embodiment of the picture card of the present invention.

FIG. 8 illustrates a fourth embodiment of a picture card 64 that includes a front card 66, similar to front card 11 of FIGS. 1–3. Here, however, front card 66 includes an image 17 printed directly thereon. Therefore, front card 66 does not require an opening like front card 11. A transparency 68 includes at least a portion of the image on front card 66. Transparency 68 is rotatably secured to front card 66. The image on the transparency overlays the image on the front card. Transparency 68 may then be rotated to bring the two corresponding images into focus.

Figure 9:
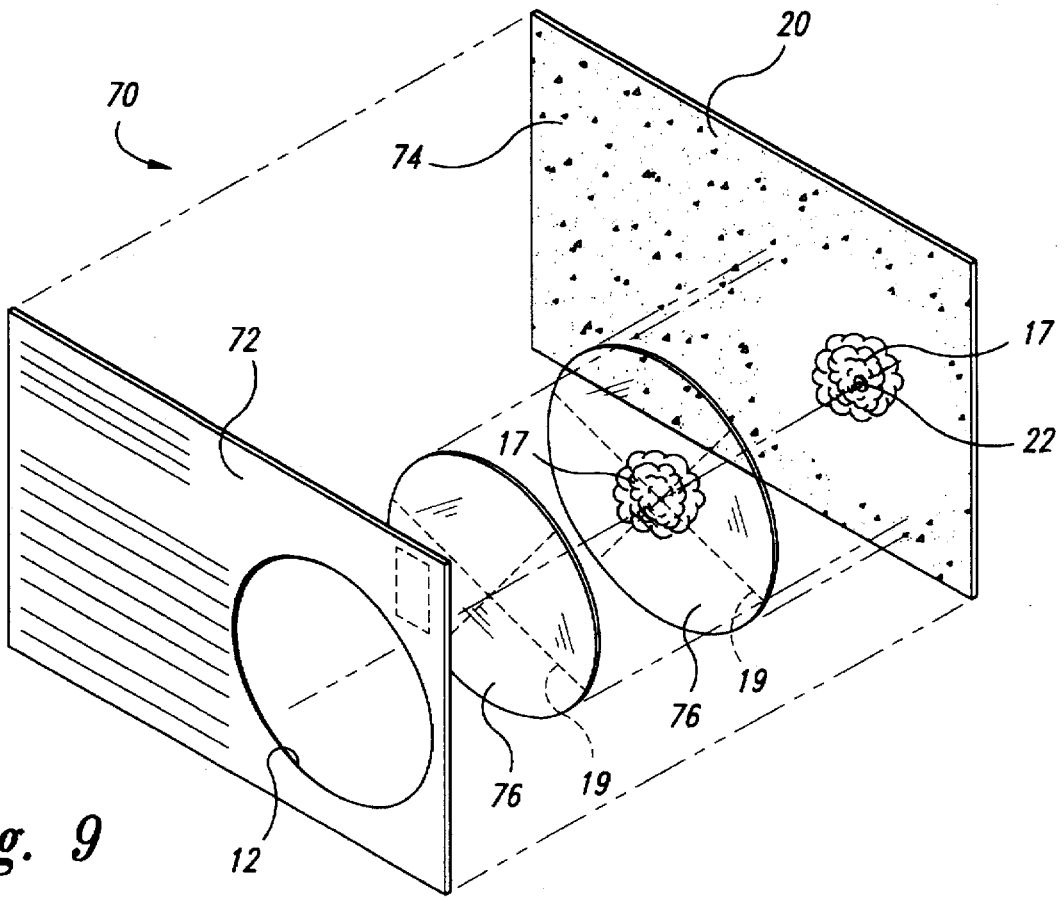
FIG. 9 is an exploded pictorial view of a fifth embodiment of the picture card of the present invention.

FIG. 9 discloses a fifth embodiment of a picture 70 having a front card 72 and a back card 74. Front card 72 is like that of front card 11 of FIGS. 1–3. Back card 74 is like that of back card 10 of FIGS. 1–3, except that an image 17 is printed directly onto card 11. At least one transparency 76 is rotatably secured to back card 74 and includes at least a portion of the same image as that on back card 74. The front card 72 and back card 74 are affixed together with an adhesive 20 with the at least one transparency 76 between the assembled front and back cards. The image on each transparency overlays the image on the back card such that when each transparency is rotated, the common image comes into focus.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. A picture card comprising:

a front panel having an opening therein, a first transparency bounded by an outer peripheral edge, said transparency having an image thereon, a second transparency bounded by an outer peripheral edge, said transparency having a separate corresponding image thereon, the first transparency being secured to the front panel over the opening therein, and the second transparency being rotatably secured to the first transparency between the first transparency and the front panel, wherein the first transparency is of a size larger than the second transparency, so that the outer peripheral edge of the first transparency overlays the second transparency and can be mounted to the front panel, and whereby the second transparency can be rotated to bring its image into alignment with its corresponding image on the first transparency.

2. The card of claim 1, and further comprising a back panel having an opening therein adapted to align with the opening of the front panel, the first transparency being secured to the front panel by first being secured to the back panel, and the back panel being secured to the front panel.

3. The card of claim 1, wherein the images of the first and second transparencies do not individually include a full spectrum of colors, but combined do include a full spectrum.

4. The card of claim 1, wherein the first and second transparencies each include two images oriented at an angle to one another, whereby the second transparency can be rotated to a first position wherein one of its images aligns with one of the images of the first transparency, and can be rotated to a second position wherein its other image aligns with the other image of the first transparency.

5. The card according to claim 1, and further comprising a third transparency bounded by an outer peripheral edge, said third transparency having an image thereon that is at least a portion of the same image of the second and first transparency, said third transparency is rotatably secured to the second transparency whereby the third and second transparencies can be rotated to align the common image of the first, second and third transparencies and to bring the common image into focus.

* * * * *